US012752394B2

(12) United States Patent
Hsieh et al.

(10) Patent No.: US 12,752,394 B2
(45) Date of Patent: Oct. 6, 2026

(54) SYSTEM AND METHOD FOR REAL TIME INLINE MIXING CMP SLURRY

(71) Applicant: Taiwan Semiconductor Manufacturing Company, Ltd., Hsinchu (TW)

(72) Inventors: Yi-Chieh Hsieh, Hsinchu (TW); Ming-Hsiang Cheng, Hsinchu (TW); Ting-Kui Chang, Hsinchu (TW); William Weilun Hong, Hsinchu (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 295 days.

(21) Appl. No.: 18/604,064

(22) Filed: Mar. 13, 2024

(65) Prior Publication Data

US 2025/0289093 A1 Sep. 18, 2025

(51) Int. Cl.
*B24B 57/02* (2006.01)
*B24B 37/04* (2012.01)

(52) U.S. Cl.
CPC ..... *B24B 57/02* (2013.01); *B24B 37/042* (2013.01)

(58) Field of Classification Search
CPC ..... B24B 57/02; B24B 37/042
See application file for complete search history.

(56) References Cited

U.S. PATENT DOCUMENTS

| | | | | |
|---|---|---|---|---|
| 5,857,893 | A * | 1/1999 | Olsen | G01F 1/8409 451/60 |
| 2012/0276816 | A1* | 11/2012 | Ono | B24B 37/015 451/7 |
| 2019/0118332 | A1* | 4/2019 | Sugiyama | B24B 37/013 |
| 2020/0043748 | A1* | 2/2020 | Liu | B24B 37/005 |
| 2020/0180108 | A1* | 6/2020 | Kaneshige | B24B 57/02 |
| 2020/0361053 | A1* | 11/2020 | Tien | B24B 37/20 |
| 2024/0017376 | A1* | 1/2024 | Brown | B24B 37/26 |
| 2025/0299968 | A1* | 9/2025 | Lin | B24B 37/015 |
| 2025/0347579 | A1* | 11/2025 | Hoang | B24B 57/02 |
| 2025/0367781 | A1* | 12/2025 | Lei | B24B 31/006 |
| 2026/0070189 | A1* | 3/2026 | Yuso | B24B 57/02 |
| 2026/0124715 | A1* | 5/2026 | Pai | B24B 57/02 |
| 2026/0131422 | A1* | 5/2026 | Lee | B24B 57/02 |

* cited by examiner

*Primary Examiner* — Omar Flores Sanchez
(74) *Attorney, Agent, or Firm* — Foley & Lardner LLP

(57) ABSTRACT

An inline CMP slurry mixing system includes a mixing device having a container and a blender, a removal rate sensor disposed adjacent to a CMP platen, a signal processor, and a process controller. The container is in fluid connection to a base slurry supply and additive supplies. The blender mixes a base slurry and multiple additives into a slurry mixture to be dispensed to the CMP platen. The removal rate sensor detects an instant removal rate of the CMP platen on a substrate. The signal processor compares the instant removal rate with a reference removal rate, and then determines whether to adjust one or more of flow rates of the base slurry and the additives based on the comparing. The process controller adjusts one or more of the flow rates of the base slurry and the additives based on the determining by the signal processor.

20 Claims, 11 Drawing Sheets

SYSTEM AND METHOD FOR REAL TIME INLINE MIXING CMP SLURRY

BACKGROUND

The semiconductor industry has experienced rapid growth due to improvements in the integration density of a variety of electronic components (e.g., transistors, diodes, resistors, capacitors, etc.). During manufacturing semiconductor devices, Chemical Mechanical Polishing (CMP) processes are widely used.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
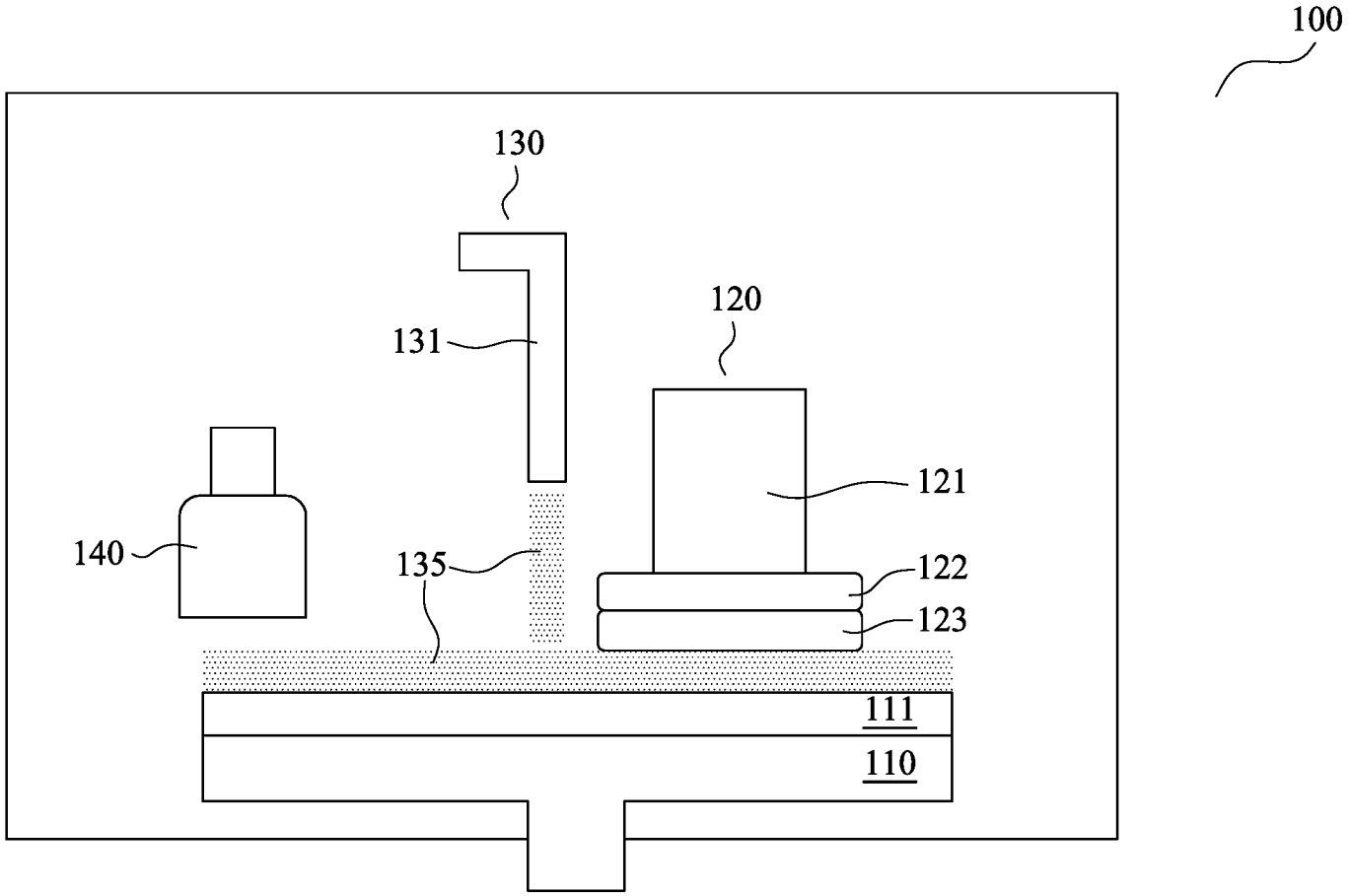
FIG. 1 is a schematic view of an apparatus for chemical mechanical polishing (CMP) in accordance with an embodiment.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over, or on a second feature in the description that follows may include embodiments in which the first and second features are formed in direct contact and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" "top," "bottom" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Wafers are typically planarized using chemical mechanical polishing (CMP) processes, which use a polishing pad and a chemical slurry. The slurry is typically a colloid of a material that acts as a chemical etchant for etching the material at the top surface of the wafer. The polishing pad is rotated relative to the wafer while slurry is disposed so as to remove material and smooth any irregular topography. During CMP processes, CMP tools (e.g., CMP platens) and slurries including multiple slurry components (such as abrasives and multiple additives) are used to polish semiconductor wafers, in which the slurries play an important role and impact on the product quality of the semiconductor wafers. There are different approaches of mixing slurry components, such as a pre-mixing approach and an inline mixing approach. The pre-mixing approach is carried out by vendors at vendor sites, and may have time consuming and cost consuming drawbacks due to multiple slurry evaluations at vendor sites, slurry shipments, and multiple on-site slurry evaluations. The inline mixing approach can have time-efficient and cost-efficient advantages, however, may face technical challenges, such as efficiently and precisely providing mixed slurries in an automatic way to the CMP platens on site.

The present disclosure relates to systems and methods for inline mixing CMP slurry components used in semiconductor manufacturing. In some embodiments, an inline CMP slurry mixing system is provided to be used along with a CMP apparatus including the CMP platen. The inline CMP slurry mixing system includes a mixing device that has a container and a blender, at least a removal rate sensor disposed adjacent to the CMP platen, a signal processor, and a process controller. The container is in fluid connection to a base slurry supply and multiple additive supplies. The blender mixes a base slurry and multiple additives into a slurry mixture to be dispensed to the CMP platen. The removal rate sensor detects an instant removal rate of the CMP platen on a control wafer. The signal processor compares the instant removal rate with a reference removal rate, and then determines whether to adjust one or more of flow rates of the base slurry and the additives based on the comparing. The process controller adjusts one or more of the flow rates of the base slurry and the additives via corresponding regulators based on the determination made by the signal processor. In this way, the inline CMP slurry mixing system can efficiently and precisely adjust the slurry mixture in real time, thereby favorably shortening the slurry evaluation time and improving the effects of the CMP process.

FIG. 1 schematically illustrates an apparatus 100 for performing a chemical mechanical polishing (CMP) process on a semiconductor wafer in accordance with an embodiment of the present disclosure. In some embodiments, the CMP apparatus 100 includes a chamber enclosing a rotatable platen 110, a polishing head assembly 120, a chemical slurry supply system 130, and a pad conditioner 140.

In an embodiment, the platen 110 is connected to a motor (not shown) that rotates the platen 110 at a preselected rotational speed. In an embodiment, the platen 110 is covered with a replaceable polishing pad 111 (interchangeably referred to herein as "the pad") of a relatively soft material. In some embodiments, the pad 111 is a thin polymeric disc with a grooved surface, and can be porous or solid, depending on the application. Factors determining the material and physical properties of the pad 111 include the material to be polished (i.e., material at the wafer surface), and the desired roughness after polishing. The pad 111 may have a pressure sensitive adhesive on the back so that the pad 111 adheres to the platen 110. During the polishing process, the pad may be wetted with a suitable lubricant material, depending on the type of material being polished (i.e., the material at the top surface of the wafer).

In an embodiment, the polishing head assembly 120 includes a head 121 and a carrier 122. The head 121 holds the carrier 122 which in turn holds a wafer 123 to be polished. In some embodiments, the assembly 120 includes a displacement mechanism (not shown) to oscillate the head 120 sideways (with reference to FIG. 1). In some embodiments, the head 121 may include a motor for rotating the wafer 123 relative to the platen 110. In some embodiments, the wafer 123 and the platen 110 are rotated in an asynchronous non-concentric pattern to provide a non-uniform relative motion between the platen 110 and the wafer 123. The non-uniformity of the relative motion facilitates uniform removal of material from the wafer surface by avoiding repeated removal from the same spot. The assembly 120 applies a controlled downward pressure to the wafer 123 to hold the wafer 123 against the platen 110.

The slurry supply system 130 introduces a chemical slurry 135 (interchangeably referred to herein as "slurry" and "slurry mixture") of a suitable material to be used as an abrasive medium between the pad 111 and the wafer 123. In an embodiment, the slurry 135 includes a colloid of abrasive particles dispersed in water with other chemicals such as rust inhibitors and bases to provide an alkaline pH. In some embodiments, the abrasive particles are of materials such as, for example, silica, ceria, and alumina. In an embodiment, the abrasive particles have a generally uniform shape and a narrow size distribution, with average particle size ranging from about 10 nm to about 100 nm or more depending on the application for which it is being used. In an embodiment, the slurry supply system 130 includes a storage system (not shown in FIG. 1) and a conduit 131 for delivering the slurry 135 to the polishing pad 111 atop the platen 110. The rate of flow of the slurry 135 may be controlled and adjusted based on the application.

In an embodiment, the pad conditioner 140 periodically "conditions" the polishing pad 111 to provide uniform thickness and roughness across the entire area of the platen 110 by polishing the pad 111. Maintaining the thickness and roughness of the pad 111 prevents unwanted pressure points or warpage on the wafer 123 during the polishing process, and helps to maintain uniform thickness of the wafer 123.

Figure 2:
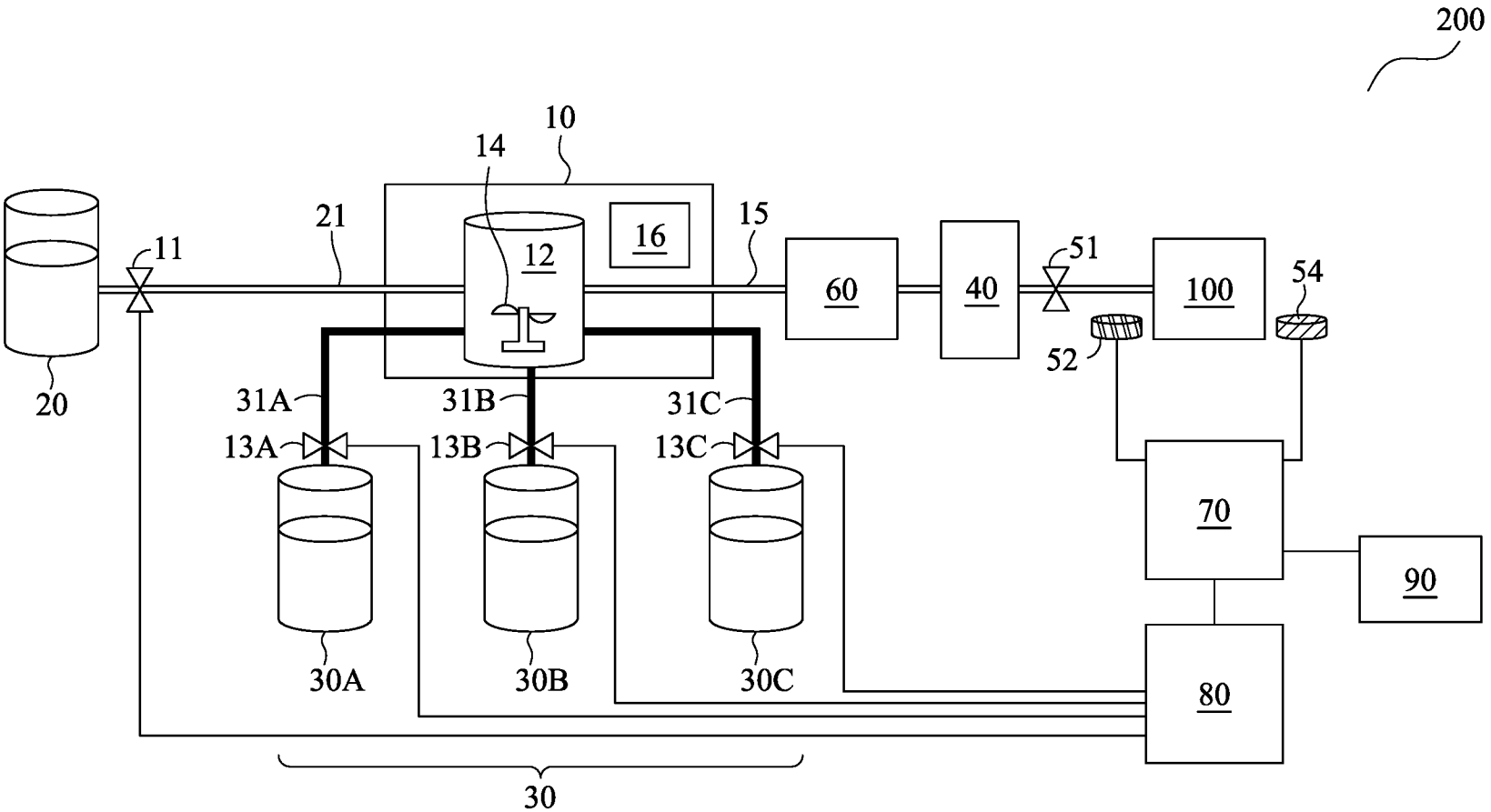
FIG. 2 is a schematic view of an inline CMP slurry mixing system in accordance with an embodiment.

FIG. 2 is a schematic view of an inline CMP slurry mixing system 200 in accordance with an embodiment. In some embodiments, the inline CMP slurry mixing system 200 is in fluid connection to a CMP apparatus 100 (as shown in FIG. 1). In some embodiments, the inline CMP slurry mixing system 200 includes a mixing device 10 that has a container 12 in fluid connection to the CMP apparatus 100 via a slurry mixture conduit 15; a base slurry supply 20 in fluid connection to the container 12 via a base slurry conduit 21; and multiple additive supplies 30 (such as 30A, 30B, and 30C) in fluid connection to the container 12 via multiple additive conduits 31 (such as 31A, 31B and 31C) respectively. In some embodiments, the base slurry supply 20 supplies a base (or basic) slurry that includes an abrasive via the base slurry conduit 21 to the container 12, and the multiple additive supplies 30 respectively supply multiple additives via the multiple additive conduits 31 to the container 12. In some embodiments, one of the multiple additives includes one selected from a group consisting of a pH adjuster, a first Cu inhibitor, a second Cu inhibitor, $H_2O_2$, and an ammonium salt.

In some embodiments, a base slurry regulator 11 is disposed on the base slurry conduit 21 to control a flow rate of the base slurry flowing from the base slurry supply 20 to the container 12, and multiple additive regulators 13 (such as 13A, 13B and 13C) are disposed on the multiple additive conduits 31 to control flow rates of the multiple additives flowing from the multiple additive supplies 30 (such as 30A, 30B and 30C) to the container 12, respectively. In some embodiments, a slurry mixture regulator 51 is disposed on the slurry mixture conduit 15 adjacent to the CMP apparatus 100 to control the slurry mixture supplied from the container 12 to the CMP apparatus 100. In some embodiments, the base slurry regulator 11, the additive regulators 13, and the slurry mixture regulator 51 are implemented as valves.

In some embodiments, the mixing device 10 further includes a blender 12 therein to facilitate mixing the base slurry and the multiple additives into a slurry mixture (corresponding to the slurry 135 in FIG. 1), which will be supplied to the CMP apparatus 100. In some embodiments, the mixing device 10 further includes a heater 16 to maintain the mixing device 10 in a temperature that facilitates uniformity of the slurry mixture. In some embodiments, the temperature is in a range that is from 20° C. to 60° C.

In some embodiments, the inline CMP slurry mixing system 200 further includes a slurry filter 40 disposed in fluid connection between the container 12 and the CMP apparatus 100 to filter out over-sized particles in the slurry mixture. In some embodiments, the inline CMP slurry mixing system 200 further includes a pump 60 disposed in fluid connection between the container 12 and the CMP apparatus 100 to pump the base slurry and the additives from the base slurry supply 20 and the additive supplies 30 into the container 12 of the mixing device 10, and pump the slurry mixture 135 from the container 12 to the CMP apparatus 100.

Referring to both FIG. 1 and FIG. 2, in some embodiments, the inline CMP slurry mixing system 200 further includes at least one removal rate (RR) sensor 52 disposed adjacent to a polishing platen 110 of the CMP apparatus 100 to detect an instant removal rate ($RR_1$) of the CMP apparatus 100 on a control wafer 123, which is a standard wafer used for testing a removal rate of a CMP platen 110 of the CMP apparatus 100. In some embodiments, the inline CMP slurry mixing system 200 further includes at least one a removal dishing (RD) sensor 54 disposed adjacent to the polishing platen 110 of the CMP apparatus 100 to detect an instant removal dishing ($RD_1$) of the CMP apparatus 100 on the control wafer.

In some embodiments, the inline CMP slurry mixing system 200 further includes a signal processor 70. In some embodiments, as shown in FIG. 2, the data storage 90 is within the inline CMP slurry mixing system 200, while in other embodiments, the data storage 90 is outside and accessible to the inline CMP slurry mixing system 200. In some embodiments, the signal processor 70 is configured to compare the detected instant removal rate ($RR_1$) and a reference standard removal rate ($RR_{ref1}$), and to determine whether to adjust at least one of flow rates of the base slurry and the multiple additives based on the comparing result. In some embodiments, the inline CMP slurry mixing system 200 further includes a database storage 90, which includes a lookup table (not shown) recording reference removal rates $RR_{ref}$ (such as $RR_{ref1}$, $RR_{ref2}$, $RR_{ref3}$ . . . ), which are ideal known removal rates for various CMP processes on the control wafer. In some embodiments, upon detecting a difference of the instant removal rate ($RR_1$) and the reference removal rate ($RR_{ref1}$) greater than a threshold value ($\Delta RR$), the signal processor 70 determines to adjust one or more of the flow rates of the base slurry and the additives to reduce this difference.

In some embodiments, the signal processor 70 is configured to compare an instant removal dishing ($RD_1$) and a reference removal dishing ($RD_{ref1}$), and to determine whether to adjust at least one of flow rates of the base slurry and the multiple additives based on the comparing result. In some embodiments, the database storage 90 includes a lookup table (not shown) including ideal known reference removal dishing $RD_{ref}$ (such as $RD_{ref1}$, $RD_{ref2}$, $RD_{ref3}$ . . . ) for various CMP processes on the control wafer. In some embodiments, upon detecting a difference of the instant removal dishing ($RD_1$) and the reference removal dishing ($RD_{ref1}$) greater than a threshold value ($\Delta RD$), the signal processor 70 determines to adjust one or more of the flow rates of the base slurry and the multiple additives to reduce this difference.

In some embodiments, the inline CMP slurry mixing system 200 further includes a process controller 80, which is configured to adjust at least one of the flow rates of the base slurry and the multiple additives respectively supplied from the base slurry supply 20 and the multiple additive supplies 30 based on the determination made by the signal processor 70. In some embodiments, as shown in FIG. 2, the process controller 80 is capable of adjusting the flow rate of the base slurry from the base slurry supply 20 via the base slurry regulator 11, and adjusting the flow rates of the multiple additives from the multiple additive supplies 30 (such as 30A, 30B, and 30C) via the multiple additive regulators 13 (such as 13A, 13B, and 13C), respectively. In this way, the base slurry and the additives can be efficiently and precisely adjusted in real time.

In some embodiments, upon detecting the difference of the instant removal rate $RR_1$ and the reference removal rate $RR_{ref1}$ equal to or less than a threshold value $\Delta RR$, the signal processor 70 determines to stop adjusting any of the flow rates of the base slurry and the multiple additives, and then the process controller 80 stops adjusting any of the flow rates of the base slurry and the multiple additives.

In some embodiments, upon detecting the difference of the instant removal dishing ($RD_1$) and the reference removal dishing ($RD_{ref1}$) equal to or less than a threshold value ($\Delta RD$), the signal processor 70 determines to stop adjusting any of the flow rates of the base slurry and the multiple additives, and then the process controller 80 stops adjusting any of the flow rates of the base slurry and the multiple additives.

In some embodiments, upon detecting the difference of the instant removal rate ($RR_1$) and the reference removal rate ($RR_{ref1}$) equal to or less than the threshold value ($\Delta RR$), as well as the difference of the difference of the instant removal dishing ($RR_1$) and the reference removal dishing ($RR_{ref1}$) equal to or less than the threshold value ($\Delta RR$), the signal processor 70 determines to stop adjusting any of the flow rates of the base slurry and the multiple additives, and then the process controller 80 stops adjusting any of the flow rates of the base slurry and the multiple additives.

In some embodiments, upon determining stopping adjusting any of the flow rates of the base slurry and the multiple additives, the signal processor 70 stores latest values of the flow rates of the base slurry and the multiple additives after the last adjusting by the process controller 80. In some embodiments, the signal processor 70 stores the latest values of the flow rates of the base slurry and the multiple additives into a table of the data storage 90 to be used in future CMP processes. In other embodiments, the signal processor 70 updates an existing table in the data storage 90 by using the latest values of the flow rates of the base slurry and the multiple additives for future CMP processes.

Figure 3:
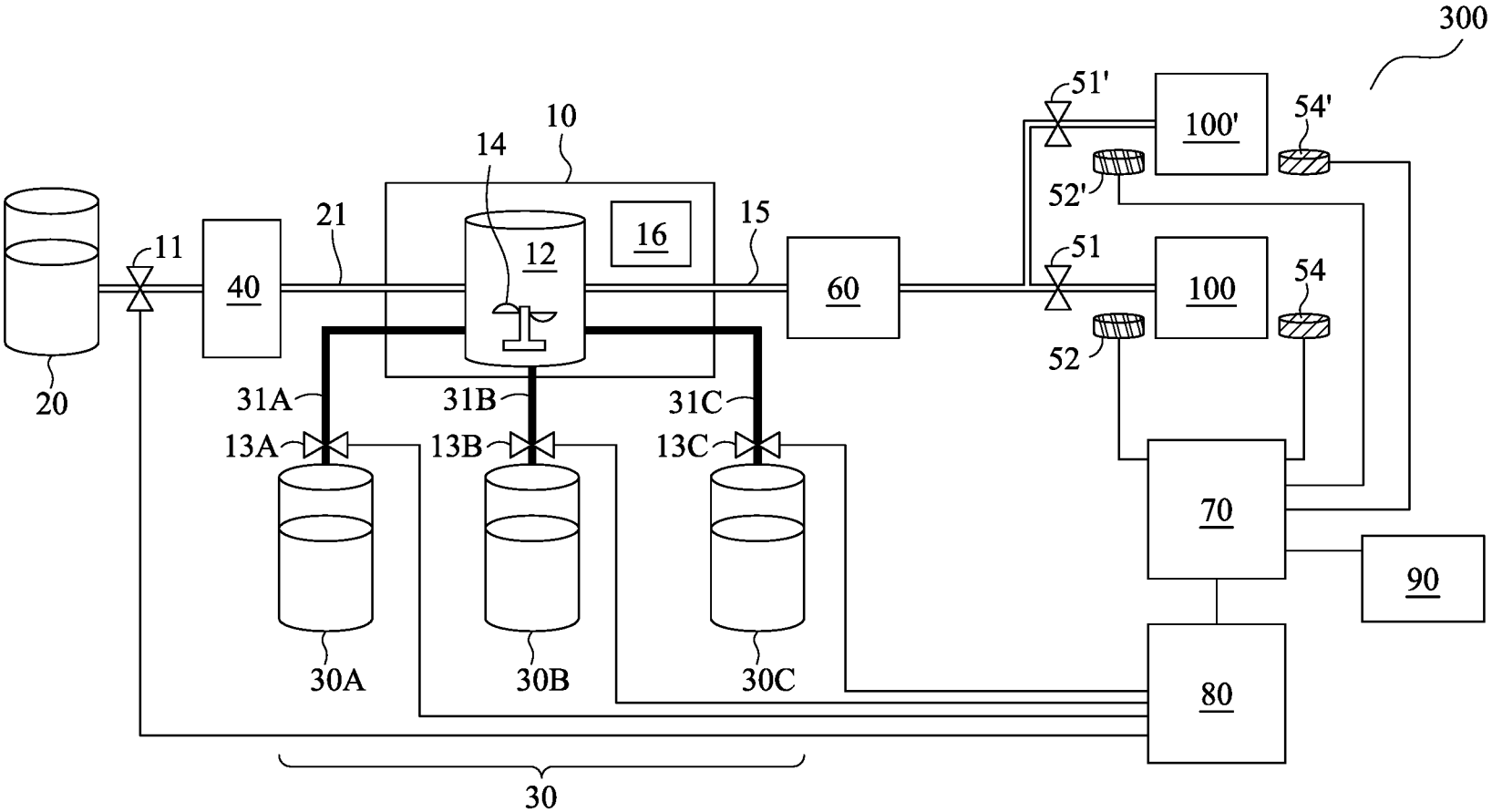
FIG. 3 is a schematic view of an inline CMP slurry mixing system in accordance with another embodiment.

FIG. 3 is a schematic view of an inline CMP slurry mixing system 300 in accordance with another embodiment. The inline CMP slurry mixing system 300 is similar to the inline CMP slurry mixing system 200, but has some differences. The inline CMP slurry mixing system 300 includes a base slurry supply 20 to hold a base slurry including an abrasive, multiple additive supplies 30 (such as 30A, 30B and 30C) to respectively hold multiple additives (such as a pH adjuster, a first Cu inhibitor, a second Cu inhibitor, $H_2O_2$, and an ammonium salt), and a mixing device 10. In some embodiments, the mixing device 10 includes a container 12, which holds and mixes the base slurry and the multiple additives, is connected to the base slurry supply 20 via a base slurry conduit 20 controlled by a base slurry regulator 11, and is connected to the multiple additive supplies 30 (such as 30A, 30B and 30C) via additive conduits 31 (such as 31A, 31B and 31C) controlled by additive regulators 13 (such as 13A, 13B and 13C), respectively. In some embodiments, mixing device 10 also includes a blender 14 in the container 12 to facilitate mixing the base slurry and the multiple additives into the slurry mixture 135, and a heater 16 to keep the mixing device 10 at a temperature in a range (such as from 20° C. to 60° C.).

Figure 4:
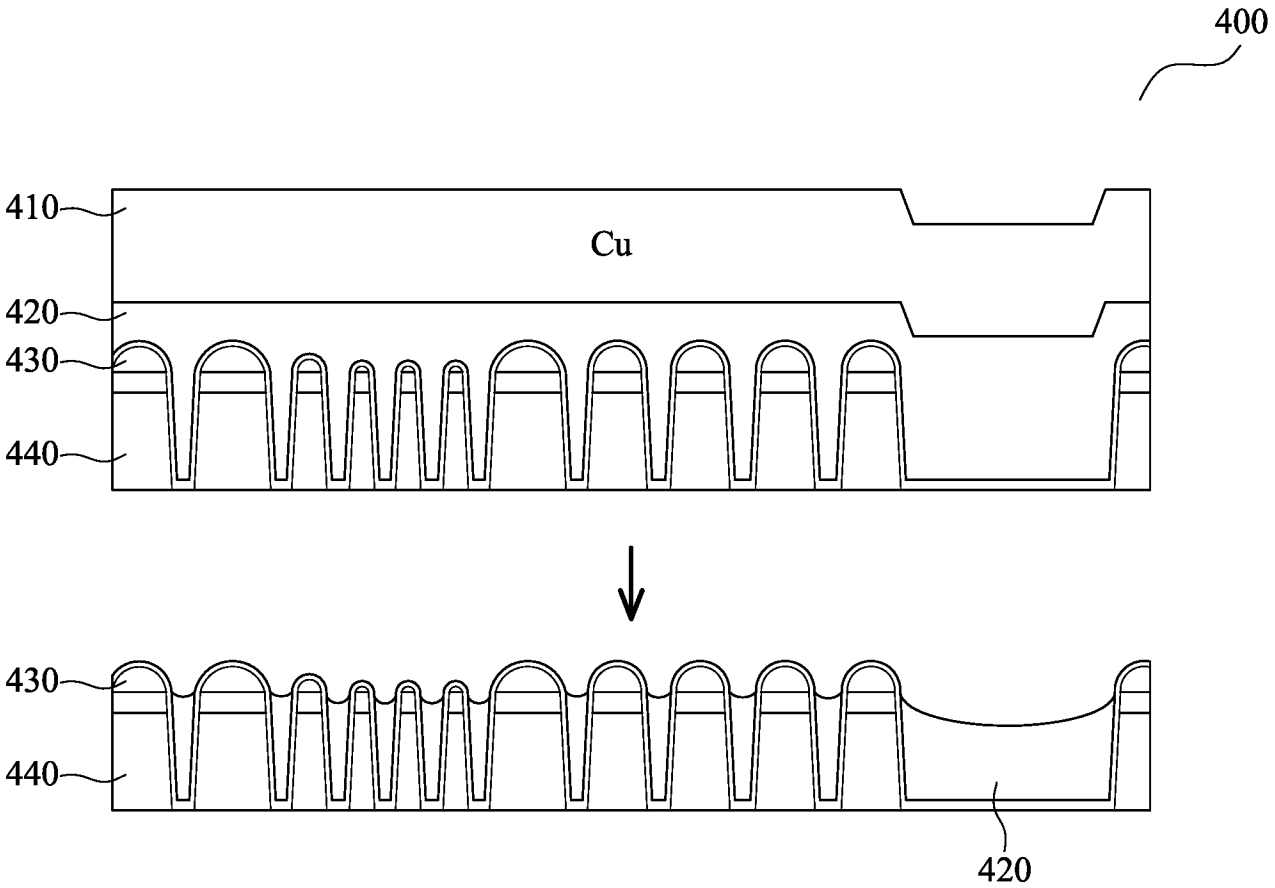
FIG. 4 shows an example bulk CMP polishing in accordance with an embodiment.
Figure 5:
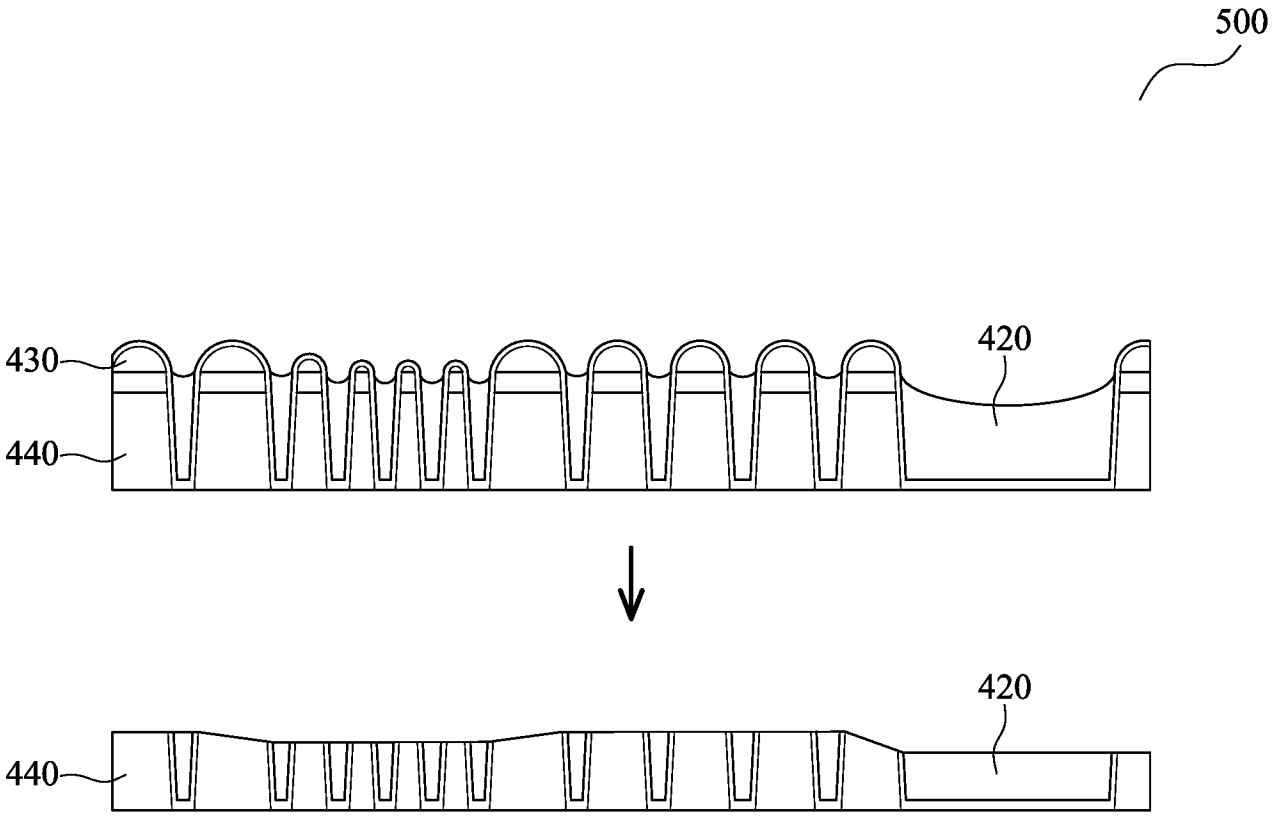
FIG. 5 shows an example buff CMP polishing in accordance with an embodiment.

In some embodiments, the inline CMP slurry mixing system 300 also includes slurry dispense devices (such as a slurry conduit 131 in FIG. 1) to dispense the slurry mixture to a first CMP apparatus 100 and/or a second CMP apparatus 100'. Each of the first CMP apparatus 100 and the second CMP apparatus 100' has a CMP platen 110 as shown in FIG. 1. The first CMP apparatus 100 is in fluid connection to the container 12 via a slurry mixture conduit 15 and controlled by a first slurry mixture regulator 51, and the second CMP apparatus 100' is in fluid connection to the container 12 via the slurry conduit 15 and controlled by a second slurry mixture regulator 51'. In some embodiments, the first CMP apparatus 100 is used for a bulk CMP polishing that is a relatively more aggressive CMP polishing at a relatively fast removal rate, and the second CMP apparatus 100' is used for a buff CMP polishing that is a relatively less aggressive CMP polishing at a relatively slow removal rate. FIG. 4 shows an example bulk CMP polishing operation 400 applied at a relatively fast removal rate, in which the bulk polishing operation entirely removes a Cu layer 410 among other things (such as a top portion of a Cu seed layer 420), and stops at a level of a bulk CMP stop mask 430. FIG. 5 shows an example buff CMP polishing operation 500 applied at a relatively slow removal rate, in which the buff polishing operation entirely removes the bulk CMP stop mask 430, and partially removes the Cu seed layer 420 and an oxide low-k material 440.

Referring to FIG. 1 and FIG. 3, in some embodiments, the inline CMP slurry mixing system 300 further includes at least a first removal rate (RR) sensor 52 disposed adjacent to the first CMP apparatus 100 to detect an instant removal rate ($RR_1$) of the first CMP apparatus 100 on a control wafer 123, which is a standard wafer used for testing a removal rate of a CMP platen 110 of the first CMP apparatus 100. In some embodiments, the inline CMP slurry mixing system 300 further includes at least one a first removal dishing (RD) sensor 54 disposed adjacent to the first CMP apparatus 100 to detect an instant removal dishing ($RD_1$) of the first CMP apparatus 100 on the control wafer 123.

Referring also to FIG. 1 and FIG. 3, in some embodiments, the inline CMP slurry mixing system 300 further includes at least a second removal rate (RR) sensor 52' disposed adjacent to the second CMP apparatus 100' to detect an instant removal rate ($RR_2$) of the second CMP apparatus 100' on a control wafer 123, which is a standard wafer used for testing a removal rate of a CMP platen 110 of the second CMP apparatus 100'. In some embodiments, the inline CMP slurry mixing system 300 further includes at least a second removal dishing (RD) sensor 54' disposed adjacent to the second CMP apparatus 100' to detect an instant removal dishing ($RD_2$) of the second CMP apparatus 100' on the control wafer 123.

As shown in FIG. 3, in some embodiments, the inline CMP slurry mixing system 300 further includes a signal processor 70 to process detected data from the first removal rate (RR) sensor 52 and the first removal dishing (RD) sensor 54, as well as the second removal rate (RR) sensor 52' and the second removal dishing (RD) sensor 54'. In some embodiments, similar to as explained with respect to FIG. 2, the signal processor 70 analyzes the data received from the sensors such as 52, 54, 52' and 54', and determines whether to adjust one or more of the flow rates of the base slurry and the multiple additives, or to stop adjusting any of the flow rates of the base slurry and the multiple additives.

In some embodiments, the inline CMP slurry mixing system 300 further includes a process controller 80. In some embodiments, similar to as explained with respect to FIG. 2, based on the determination made by the signal processor 70, the process controller 80 adjusts one or more of the flow rates of the base slurry and the multiple additives via the base slurry regulator and the multiple additive regulators.

In some embodiments, similar to as explained with respect to FIG. 2, upon determining stopping adjusting one or more of the flow rates of the base slurry and the additives, the signal processor 70 stores the latest values of the flow rates of the base slurry and the multiple additives after the last adjusting by the process controller 80. In some embodiments, the signal processor 70 stores the latest values of the flow rates of the base slurry and the multiple additives into a table in the data storage 90 for future CMP process use. In other embodiments, the signal processor 70 updates an existing table of the data storage 90 by using the latest values of the flow rates of the base slurry and the multiple additives for future CMP processes.

In some embodiments, as shown in FIG. 3, different from the embodiments as shown in FIG. 2, the inline CMP slurry mixing system 300 includes a slurry filter 40 that is disposed in fluid connection between the base slurry supply 20 and the container 12 to filter out over-sized particles of the base slurry supplied from the base slurry supply 20.

In some embodiments, the inline CMP slurry mixing system 200 further includes a pump 60 disposed in fluid connection between the container 12 as well as the first and the second CMP apparatuses 100 and 100' to pump the base slurry and the multiple additives from the base slurry supply 20 and the multiple additive supplies 30 into the container 12, and to pump the slurry mixture 135 (in FIG. 1) from the container 12 into the first the second CMP apparatuses 100 and 100'.

Figure 6:
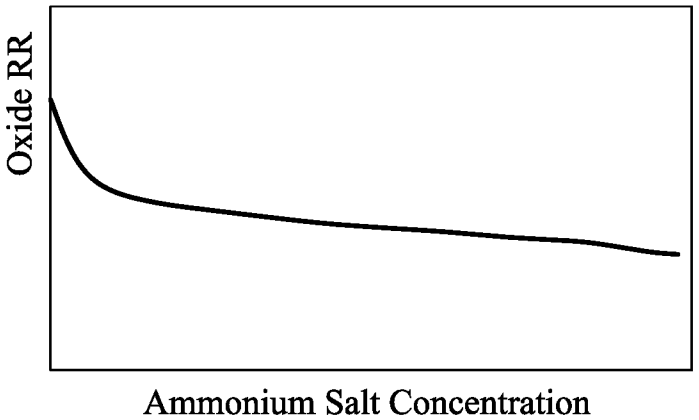
FIGS. 6-9 are charts illustrating example CMP performance trends with increasing additives in accordance with some embodiments.
Figure 7:
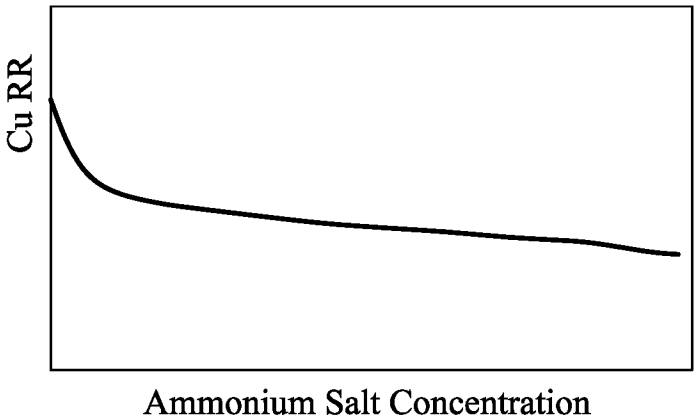
Figure 9:
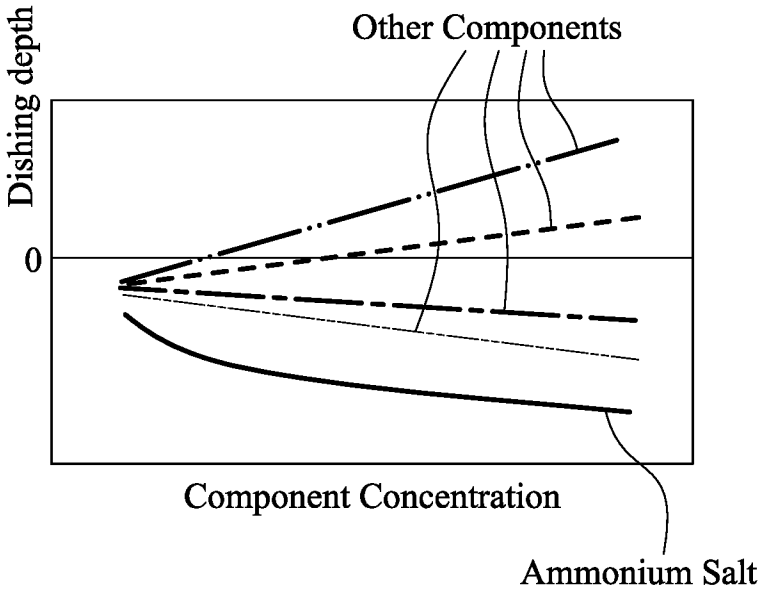
Figure 8:
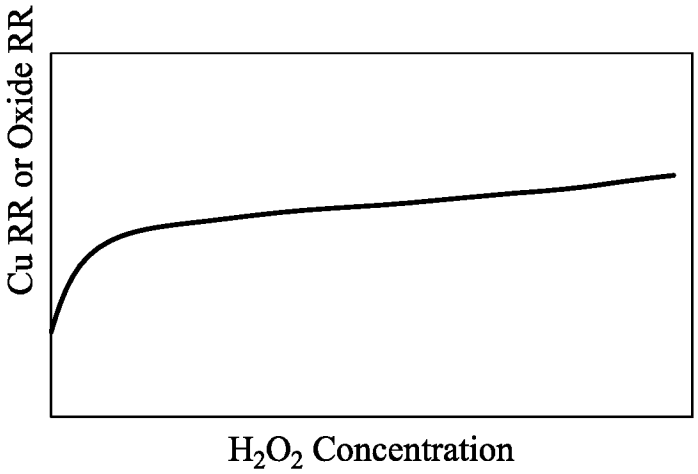

FIGS. 6, 7, 8 and 9 are charts illustrating example CMP performance trends with increasing additives (e.g., ammonium salt and $H_2O_2$) in a slurry mixture in accordance with some embodiments. FIG. 6 shows an impact of ammonium concentration in the slurry mixture on a CMP oxide removal rate (RR), in which the CMP oxide removal rate decreases with an increasing ammonium salt concentration in the slurry mixture. FIG. 7 shows an impact of ammonium salt concentration in the slurry mixture on a CMP Cu removal rate (RR), in which the CMP Cu removal rate decreases with an increasing ammonium salt concentration in the slurry mixture. FIG. 8 shows an impact of $H_2O_2$ concentration in the slurry mixture on a CMP Cu or oxide removal rate (RR), in which the CMP Cu or oxide removal rate increases with an increasing $H_2O_2$ concentration in the slurry mixture. FIG. 9 shows various impacts of various concentrations of additives (such as ammonium salt) in the slurry mixture on a CMP removal dishing depth. For example, the CMP removal dishing depth decreases with an increasing concentration of some additives (such as ammonium salt) in the slurry mixture, while the CMP removal dishing depth increases with an increasing concentration of other additives.

Based on different impacts of various concentrations of various additives (such as a pH adjusters, Cu inhibitors, $H_2O_2$, and ammonium salts) on the removal rates RR and polishing dishing depths RD to various polishing targets (such as Cu or oxide layers), the process controller 80 can adjust one or more flow rates of the various multiple additives via one or more flow rate regulators 13 based on the analysis and determination made by the signal processor 70. In this way, the process controller 80 can adjust one or more concentrations of the multiple additives 30 to obtain an improved slurry mixture 135, which can be used by the CMP platen 110 of the CMP apparatus 100 to get a desirable removal rate and a desirable removal dishing depth.

Figure 10:
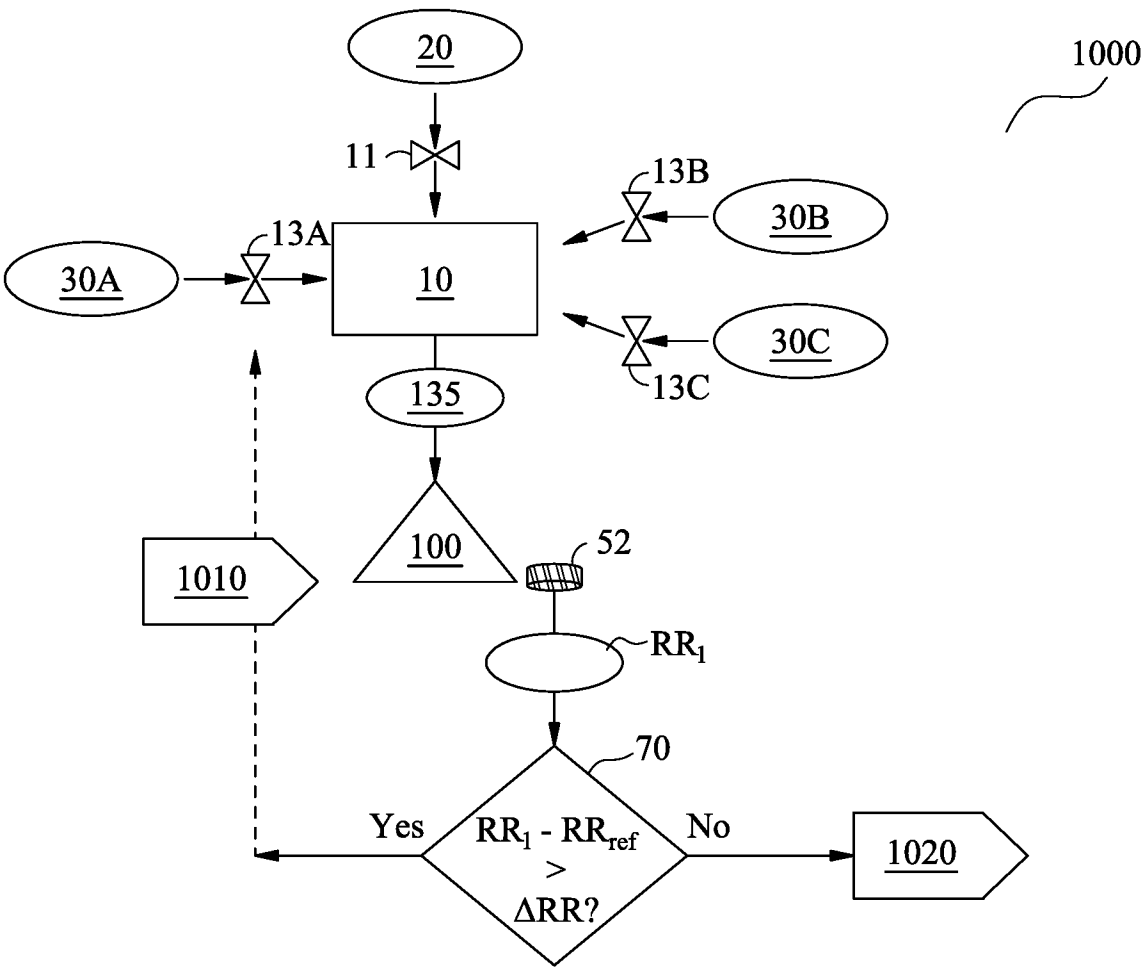
FIG. 10 is a schematic view illustrating a Close Loop Control (CLS) method of an inline CMP slurry mixing process in accordance with an embodiment.

FIG. 10 is a schematic view 1000 illustrating a Close Loop Control (CLS) method of an inline CMP slurry mixing process in accordance with an embodiment. Referring to e.g., FIGS. 1, 2 and 10, a base slurry from a base slurry supply 20 and multiple additives respectively from one or more multiple additive supplies 30A-30C are first supplied respectively via a base slurry regulator 11 and one or more multiple additive regulators 13A-13C to a mixing device 10 including a container 12, which mixes the base slurry and the one or more multiple additives into a slurry mixture 135. Then, the slurry mixture 135 is dispended to a CMP apparatus 100 including a CMP platen 110, which is configured to CMP polish a control wafer 123. Concurrently, an instant removal rate $RR_1$ of the CMP platen 110 on the control wafer 123 is detected by a removal rate sensor 52 that is disposed adjacent to the CMP platen 110 of the CMP apparatus 100. After that, the instant removal rate $RR_1$ is compared with a reference removal rate $RR_{ref1}$ stored in a database storage 90 by a signal processor 70. Based on the comparison of the instant removal rate $RR_1$ and the reference removal rate $RR_{ref1}$, a determination is made by the signal processor 70 as to whether to adjust at least one of flow rates of the base slurry and the additives. In some embodiments, when a difference of the instant removal rate $RR_1$ and the reference removal rate $RR_{ref1}$ ($RR_1-RR_{ref1}$) is determined greater than a threshold value ($\Delta RR$), the signal processor 70 decides and instructs the process controller 80 to perform an action 1010 to adjust one or more multiple additive regulators 13A-13C to reduce the difference of the instant removal rate $RR_1$ and the reference removal rate $RR_{ref1}$. The operations mentioned above repeat until the difference of the instant removal rate $RR_1$ and the reference removal rate $RR_{ref1}$ is determined equal to or less than the threshold value (ΔRR). Once the difference of the instant removal rate $RR_1$ and the reference removal rate $RR_{ref1}$ is determined equal to or less than the threshold value (ΔRR), the signal processor 70 decides and instructs the process controller 80 to perform an action 1020, which includes stopping adjusting any of the additive regulators 13A-13C, and storing the values of the flow rates of the base slurry and the multiple additives after the last adjusting by the process controller 80 for future CMP uses.

Figure 11:
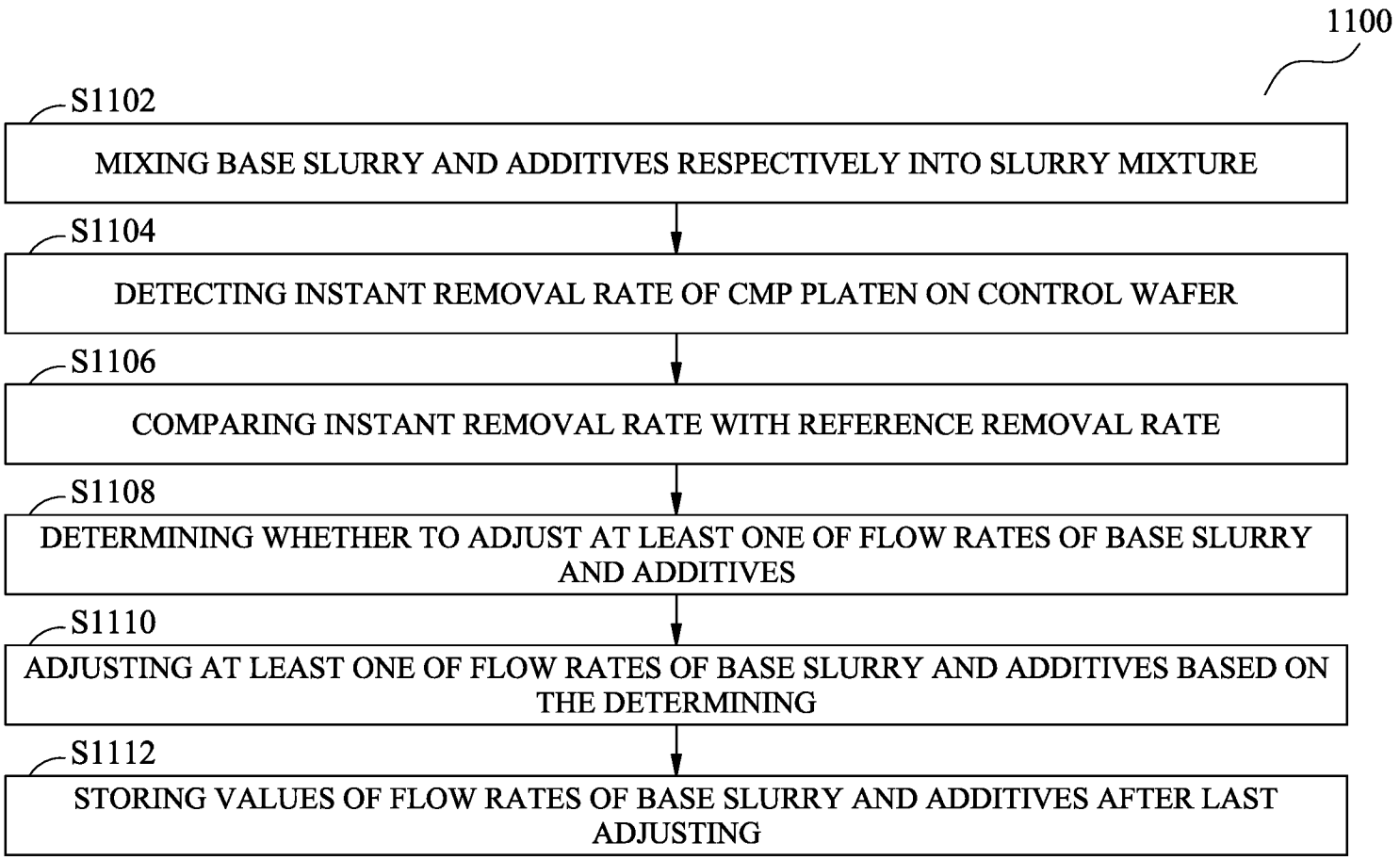
FIG. 11 is a flow chart of an inline CMP slurry mixing method in accordance with an embodiment.

FIG. 11 is a flow chart of an inline CMP slurry mixing method 1100 in accordance with an embodiment. It is noted that the method 1100 is merely an example and is not intended to limit the present disclosure. Accordingly, it is understood that additional operations may be provided before, during, and after the method 1100 of FIG. 11, and that some operations may only be briefly described herein. The order of the operations may be interchangeable.

Referring to FIGS. 1, 2 and 11, in some embodiments, the inline CMP slurry mixing method 1100 includes: at S1102, mixing, in a mixing device 10, a base slurry from a base slurry supply 20 and multiple additives respectively from multiple additive supplies 30 into a slurry mixture 135 to be is dispended by a dispense nozzle or conduit 131 to a CMP platen 110 of a CMP apparatus 100; at S1104, detecting an instant removal rate $RR_1$ of the CMP platen 110 on a control wafer 111 by a removal rate sensor 52 disposed adjacent to the CMP platen 110; at S1106, comparing the instant removal rate $RR_1$ with a reference removal rate $RR_{ref1}$ by a signal processor 70; at S1108, determining by the signal processor 70 whether to adjust at least one of flow rates of the base slurry and the multiple additives based on the comparing of the instant removal rate $RR_1$ and the reference removal rate $RR_{ref1}$; at S1110, adjusting by a process controller 80 at least one of the flow rates of the base slurry and the multiple additives based on the determining of the signal processor 70; and at S1112, storing by the signal processor 70 values of the flow rates of the base slurry and the multiple additives after the last adjusting by the process controller 80.

In some embodiments, upon detecting a difference of the instant removal rate $RR_1$ and the reference removal rate $RR_{ref1}$ greater than a threshold value ΔRR, the signal processor 70 determines and instructs the process controller 80 to adjust one or more of the flow rates of the base slurry and the multiple additives to reduce the difference, and the process controller 80 adjusts one or more of the flow rates of the base slurry and the multiple additives.

Otherwise, in some embodiments, upon detecting the difference of the instant removal rate $RR_1$ and the reference removal rate $RR_{ref1}$ less than or equal to the threshold value ΔRR, the signal processor 70 determines and instructs the process controller 80 to stop adjusting any of the flow rates of the base slurry and the multiple additives, and the process controller 80 stops adjusting any of the flow rates of the base slurry and the multiple additives. After that, the signal processor 70 stores values of the flow rates of the base slurry and the multiple additives in a data storage 90 after the last adjusting by the process controller 80.

Figure 12:
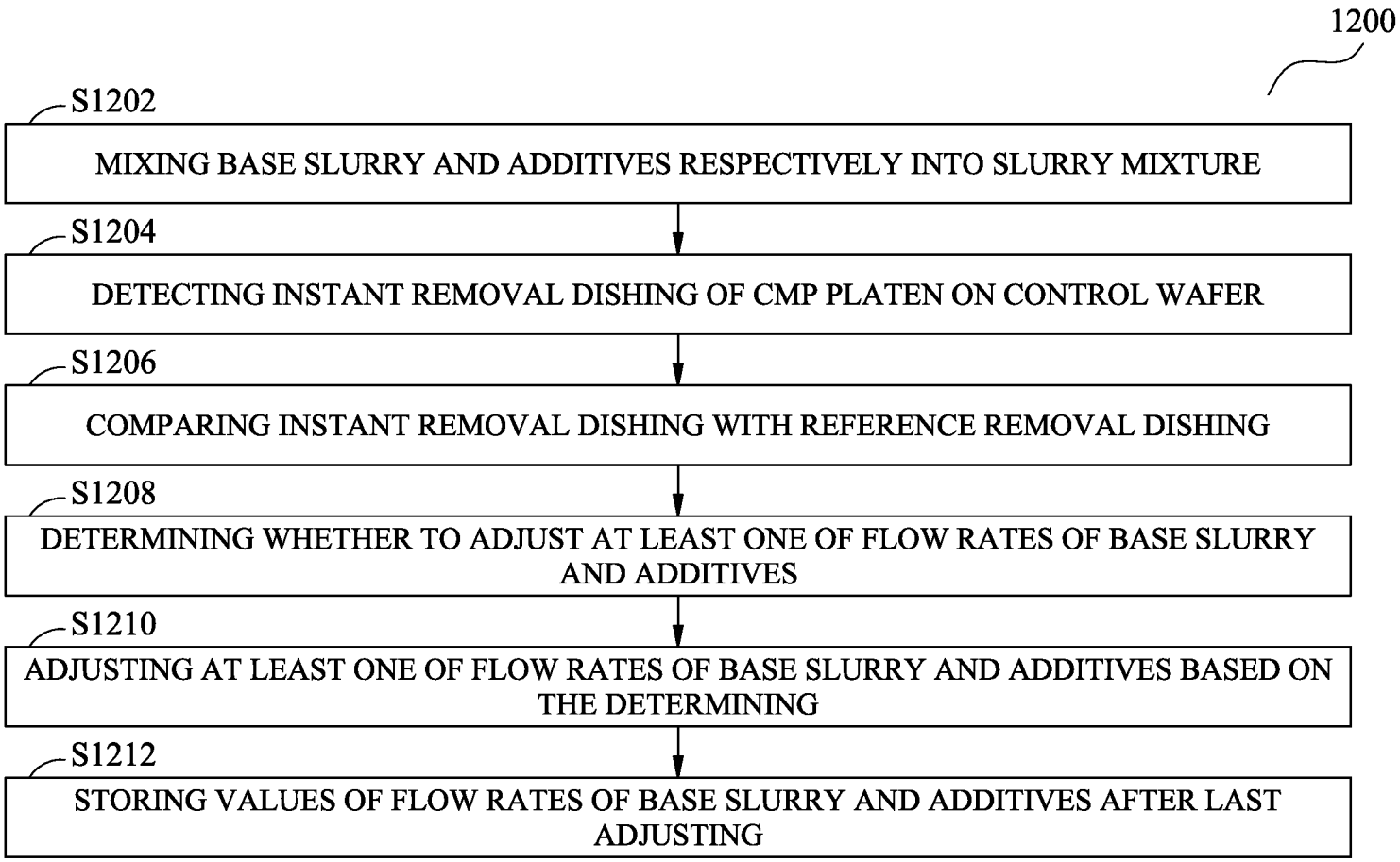
FIG. 12 is a flow chart of an inline CMP slurry mixing method in accordance with another embodiment.

FIG. 12 is a flow chart of an inline CMP slurry mixing method 1200 in accordance with another embodiment. The inline CMP slurry mixing method 1200 is similar to the inline CMP slurry mixing method 1100, but has some difference. It is noted that the method 1200 is merely an example and is not intended to limit the present disclosure. Accordingly, it is understood that additional operations may be provided before, during, and after the inline CMP slurry mixing method 1200, and that some operations may only be briefly described herein. The order of the operations may be interchangeable.

Referring to FIGS. 1, 2 and 12, in some embodiments, the inline CMP slurry mixing method 1200 includes: at S1202, mixing, in a mixing device 10, a base slurry from a base slurry supply 20 and multiple additives respectively from additive supplies 30 (such as 30A, 30B and 30C) into a slurry mixture 135, in which the slurry mixture 135 is dispended by a dispense conduit (or nozzle) 131 onto a CMP platen 110 of a CMP apparatus 100; at S1204, detecting an instant removal dishing $RD_1$ of the CMP platen 110 on a control wafer 111 by a removal dishing (RD) sensor 54 that is positioned adjacent to the CMP platen 110; at S1206, comparing the instant removal dishing $RD_1$ with a reference removal dishing $RD_{ref1}$ by a signal processor 70; at S1208, determining by the signal processor 70 whether to adjust one or more of flow rates of the base slurry and the multiple additives based on the comparison of the instant removal dishing $RD_1$ and the reference removal dishing $RD_{ref1}$; at S1210, adjusting, by a process controller 80, one or more of the flow rates of the base slurry and the multiple additives based on the determination made by the signal processor 70; and at S1212, storing by the signal processor 70 values of the flow rates of the base slurry and the multiple additives after the last adjusting performed by the process controller 80 for future CMP uses.

In some embodiments, upon detecting a difference of the instant removal dishing $RD_1$ and the reference removal dishing $RD_{ref1}$ greater than a threshold value ΔRD, the signal processor 70 determines and instructs the process controller 80 to adjust one or more of the flow rates of the base slurry and the multiple additives to reduce the difference, and the process controller 80 adjusts one or more of the flow rates of the base slurry and the multiple additives.

Otherwise, in some embodiments, upon detecting the difference of the instant removal dishing $RD_1$ and the reference removal dishing $RD_{ref1}$ less than or equal to the threshold value ΔRD, the signal processor 70 determines and instructs the process controller 80 to stop adjusting any of the flow rates of the base slurry and the multiple additives, and the process controller 80 stops adjusting any of the flow rates of the base slurry and the multiple additives. After that, the signal processor 70 stores values of the flow rates of the base slurry and the multiple additives in a data storage 90 after the last adjusting performed by the process controller 80 for future CMP uses.

Figure 14:
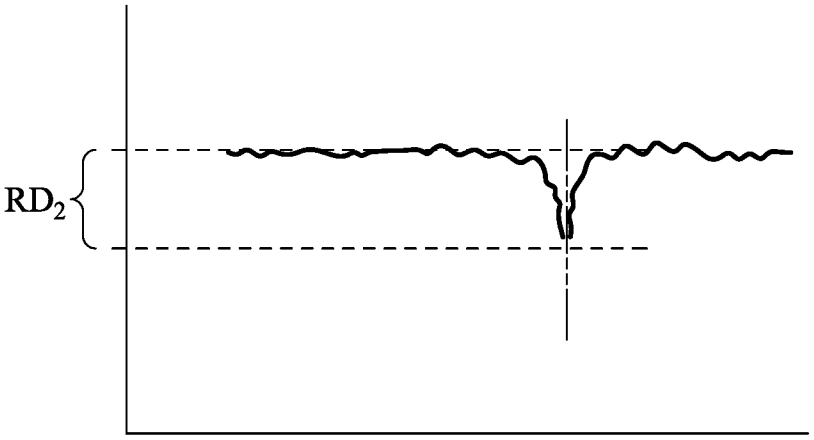
FIG. 14 illustrates a CMP removal dishing depth in a CMP process using an inline CMP slurry mixing method in accordance with an embodiment.
Figure 13:
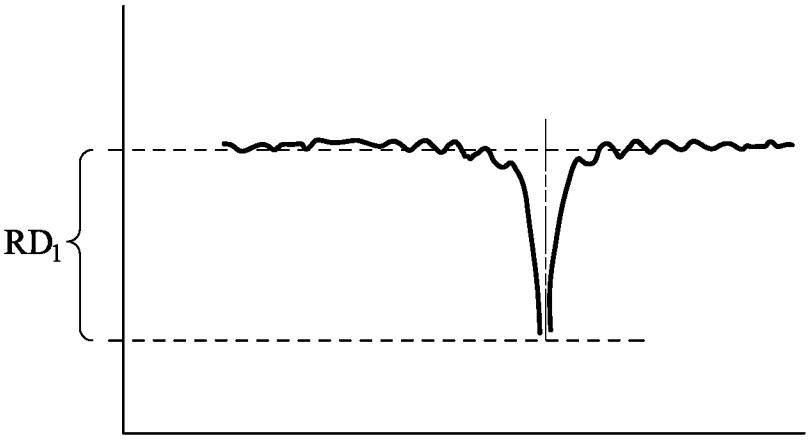
FIG. 13 illustrates a CMP removal dishing depth in a CMP process without using an inline CMP slurry mixing method.

FIG. 13 illustrates a CMP removal dishing depth $RD_1$ without using an inline CMP slurry mixing method that can be in a range from about 75 to about 85 Å, while FIG. 14 illustrates a favorably reduced CMP removal dishing depth $RD_2$ using an inline CMP slurry mixing method in accordance with an embodiment that can be in a range from about 20 to about 30 Å.

In one aspect of the present disclosure, an inline Chemical Mechanical Polishing (CMP) slurry mixing system is disclosed. The system includes: a mixing device including a container in fluid connection to a base slurry supply controlled by a first regulator and in fluid connection to additive supplies controlled by second regulators respectively, and a blender to mix a base slurry and additives in the container into a slurry mixture to be supplied to a CMP platen; a removal rate sensor disposed adjacent to the CMP platen to detect an instant removal rate of the CMP platen on a substrate; a signal processor to compare the instant removal rate and a reference removal rate, and to determine whether to adjust at least one of flow rates of the base slurry and the additives based on the comparing; and a process controller to adjust the at least one of the flow rates of the base slurry and the additives based on the determining made by the signal processor.

In another aspect of the present disclosure, an inline Chemical Mechanical Polishing (CMP) slurry mixing system is disclosed. The system includes: a base slurry supply to hold a base slurry, additive supplies to respectively hold additives, and a mixing device. The mixing device includes: a container to hold the base slurry and the additives, connected to the base slurry supply controlled by a first regulator, and connected to the additive supplies respectively controlled by second regulators; a blender to mix the base slurry and the additives into a slurry mixture; and a heater to keep the mixing device in a temperature range. The system further includes a first slurry dispense device to dispense the slurry mixture to a first CMP platen; a removal rate sensor disposed adjacent to the first CMP platen to detect an instant removal rate of the first CMP platen on a substrate; a signal processor to compare the instant removal rate with a reference removal rate, and to determine whether to adjust one or more of flow rates of the base slurry and the additives based on the comparing; and a process controller to adjust the one or more of the flow rates of the base slurry and the additives via the first regulator and the second regulators based on the determining.

In yet another aspect of the present disclosure, an inline Chemical Mechanical Polishing (CMP) slurry mixing method is disclosed. The method includes mixing, in a mixing device, a base slurry from a base slurry supply and additives respectively from additive supplies into a slurry mixture, wherein the slurry mixture is dispended by a dispense nozzle to a CMP platen; detecting an instant removal rate of the CMP platen on a substrate by a removal rate sensor that is positioned adjacent to the CMP platen; comparing the instant removal rate with a reference removal rate by a signal processor; determining by the signal processor whether to adjust at least one of flow rates of the base slurry and the additives based on the comparing of the instant removal rate and the reference removal rate; adjusting by a process controller the at least one of the flow rates of the base slurry and the additives based on the determining of the signal processor; and storing by the signal processor values of the flow rates of the base slurry and the additives after a last adjusting by the process controller.

As used herein, the terms "about" and "approximately" generally mean plus or minus 10% of the stated value. For example, about 0.5 would include 0.45 and 0.55, about 10 would include 9 to 11, about 1000 would include 900 to 1100.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An inline Chemical Mechanical Polishing (CMP) slurry mixing system, comprising:

a mixing device comprising:

a container in fluid connection to a base slurry supply controlled by a first regulator, and in fluid connection to additive supplies controlled by second regulators, respectively; and a blender to mix a base slurry and additives in the container into a slurry mixture to be supplied to a CMP platen;

a removal rate sensor disposed adjacent to the CMP platen to detect an instant removal rate of the CMP platen on a substrate;

a signal processor to compare the instant removal rate and a reference removal rate, and to determine whether to adjust at least one of flow rates of the base slurry and the additives based on the comparing; and a process controller to adjust the at least one of the flow rates of the base slurry and the additives based on the determining made by the signal processor.

2. The system of claim 1, wherein the mixing device further comprises a heater to keep a temperature in the mixing device in a range from 20° C. to 60° C.

3. The system of claim 1, further comprising a slurry filter that is in fluid connection to the mixing device and disposed between the base slurry supply and the mixing device.

4. The system of claim 1, further comprising a slurry filter that is in fluid connection to the mixing device and disposed between the mixing device and the CMP platen.

5. The system of claim 1, further comprising a pump connected to the mixing device to pump the base slurry and the additives into the mixing device.

6. The system of claim 1, wherein the base slurry comprises an abrasive, and wherein one of the additives is selected from a group consisting of a pH adjuster, a first Cu inhibitor, a second Cu inhibitor, $H_2O_2$, and an ammonium salt.

7. The system of claim 1, wherein upon detecting a difference of the instant removal rate and the reference removal rate greater than a threshold value, the signal processor determines to adjust one or more of the flow rates of the base slurry and the additives to reduce the difference, and the process controller adjusts one or more of the flow rates of the base slurry and the additives.

8. The system of claim 7, wherein upon detecting the difference less than or equal to the threshold value, the signal processor determines to stop adjusting any of the flow rates of the base slurry and the additives, and the process controller stops adjusting any of the flow rates of the base slurry and the additives.

9. The system of claim 8, wherein the signal processor stores values of the flow rates of the base slurry and the additives in a table for a future CMP process after a last adjusting by the process controller.

10. The system of claim 1, further comprising a removal dishing (RD) sensor disposed adjacent to the CMP platen to detect an occurrence of a removal dishing of the CMP platen on the substrate.

11. The system of claim 10, wherein upon detecting the occurrence of the removal dishing, the signal processor determines to adjust one or more of the flow rates of the base slurry and the additives to reduce the removal dishing, and the process controller adjusts one or more of the flow rates of the base slurry and the additives.

12. The system of claim 11, wherein upon detecting no occurrence of the removal dishing, the signal processor determines to stop adjusting any of the flow rates of the base slurry and the additives, and the process controller stops adjusting any of the flow rates of the base slurry and the additives.

13. The system of claim 12, wherein the signal processor stores values of the flow rates of the base slurry and the additives in a table for a future CMP process after a last adjusting by the process controller.

14. An inline Chemical Mechanical Polishing (CMP) slurry mixing system, comprising:

a base slurry supply to hold a base slurry;

additive supplies to respectively hold additives;

a mixing device comprising:

a container to hold the base slurry and the additives, connected to the base slurry supply controlled by a first regulator, and connected to the additive supplies respectively controlled by second regulators;

a blender to mix the base slurry and the additives into a slurry mixture; and a heater to keep the mixing device in a temperature range;

a first slurry dispense device to dispense the slurry mixture to a first CMP platen;

a removal rate sensor disposed adjacent to the first CMP platen to detect an instant removal rate of the first CMP platen on a substrate;

a signal processor to compare the instant removal rate with a reference removal rate, and to determine whether to adjust one or more of flow rates of the base slurry and the additives based on the comparing; and a process controller to adjust the one or more of the flow rates of the base slurry and the additives via the first regulator and the second regulators based on the determining.

15. The system of claim 14, further comprising a second slurry dispense device to supply the slurry mixture to a second CMP platen, wherein the first slurry dispense device and the second slurry dispense device respectively comprise a third regulator and a fourth regulator to control flow rates thereof.

16. The system of claim 14, further comprising a data storage to store values of the flow rates of the base slurry and the additives for a future CMP process after a last adjusting by the process controller.

17. An inline Chemical Mechanical Polishing (CMP) slurry mixing method, comprising:

mixing, in a mixing device, a base slurry from a base slurry supply and additives respectively from additive supplies into a slurry mixture, wherein the slurry mixture is dispended by a dispense nozzle to a CMP platen;

detecting an instant removal rate of the CMP platen on a substrate by a removal rate sensor that is positioned adjacent to the CMP platen;

comparing the instant removal rate with a reference removal rate by a signal processor;

determining, by the signal processor, whether to adjust at least one of flow rates of the base slurry and the additives based on the comparing of the instant removal rate and the reference removal rate;

adjusting, by the signal processor, the at least one of the flow rates of the base slurry and the additives based on the determining of the signal processor; and storing, by the signal processor, values of the flow rates of the base slurry and the additives after a last adjusting by a process controller.

18. The method of claim 17, wherein upon detecting a difference of the instant removal rate and the reference removal rate greater than a threshold value, the signal processor determines to adjust the at least one of the flow rates of the base slurry and the additives to reduce the difference, and the process controller adjusts the at least one of the flow rates of the base slurry and the additives.

19. The method of claim 18, wherein upon detecting the difference less than or equal to the threshold value, the signal processor determines to stop adjusting the at least one of the flow rates of the base slurry and the additives, and the process controller stops adjusting the at least one of the flow rates of the base slurry and the additives.

20. The method of claim 18, further comprising filtering the slurry mixture by a slurry filter before the slurry mixture is dispended by the dispense nozzle to the CMP platen.

* * * * *